US005104309A

United States Patent [19]

Krieger

[11] Patent Number: 5,104,309

[45] Date of Patent: Apr. 14, 1992

[54] RADIANT BURNER FOR GASEOUS FUEL

[76] Inventor: Kurt Krieger, Asternweg 47, Mönchengladbach 2, Fed. Rep. of Germany, D-4050

[21] Appl. No.: 459,769

[22] PCT Filed: May 2, 1989

[86] PCT No.: PCT/DE89/00278

§ 371 Date: Feb. 8, 1990

§ 102(e) Date: Feb. 8, 1990

[87] PCT Pub. No.: WO89/11621

PCT Pub. Date: Nov. 30, 1989

[30] Foreign Application Priority Data

May 16, 1988 [DE] Fed. Rep. of Germany ..... 3816592

[51] Int. Cl.[5] ..... F23D 3/40

[52] U.S. Cl. ..... 431/7; 431/328; 126/92 AC; 29/890.02

[58] Field of Search ..... 431/326, 328, 327, 325, 431/9, 7, 10; 126/92 R, 92 AC, 92 B, 92 C, 91 R, 86; 29/890.02, 527.2, 527.4

[56] References Cited

U.S. PATENT DOCUMENTS

| | | | |
|---|---|---|---|
| 3,445,175 | 5/1969 | Krieger | 431/328 |
| 3,529,916 | 9/1970 | Krieger | 431/329 |
| 3,661,499 | 5/1972 | Krieger | 431/328 |
| 3,885,907 | 5/1975 | Teague, Jr. | 431/328 |

FOREIGN PATENT DOCUMENTS

| | | | |
|---|---|---|---|
| 2128696 | 12/1972 | Fed. Rep. of Germany | 431/328 |

*Primary Examiner*—James C. Yeung
*Attorney, Agent, or Firm*—Louis Weinstein

[57] ABSTRACT

In a radiant burner whose head has a ceramic incandescent body with individual burner channels, the interior of the incandescent body (3) is provided with a metallic coating (7) which extends into each of the burner channels (6) and which is closed except at the entries to the channels.

35 Claims, 3 Drawing Sheets

RADIANT BURNER FOR GASEOUS FUEL

BACKGROUND OF THE INVENTION

The invention pertains to a radiant burner as described in the preamble of claim 1 and to a process for producing a burner head and an incandescent mantle for such a radiant burner.

PRIOR ART

Radiant burners with ceramic burner heads have been known for a very long time. The susceptibility of the ceramic body to cracking is a serious problem in burners of this type. This has an unfavorable effect on the life of the burner and necessitates expensive and time-consuming repair and installation work. The lost operating time of a system that uses these burners is another important consideration. Even small cracks in the incandescent mantle can lead to significant problems in the operation of the burner, because they are undesired passages for the operating medium, which can cause back-ignition and other problems.

BRIEF DESCRIPTION OF THE INVENTION

The goal of the invention is to eliminate as far as possible the previously observed problems and disadvantages and to create a radiant burner with a burner head made of ceramic or comparable material. This burner must have favorable characteristics, including especially resistance to cracks in the ceramic body, to eliminate the problems of back-ignition and short service life. The invention also intends to provide a more favorable design for a radiant burner. The invention also deals with other, related problems that are described in detail below.

In a radiant burner of this type, the invention proposes that the incandescent body be provided with a metal lining on its inside or rear side, i.e., the side facing the housing. The metal lining extends partially into the burner channels in regions called intake sections and is sealed except for the burner channel intakes formed in this way.

This means that the rear side of the incandescent body has an impenetrable seal that extends into the burner channels. Even if cracks or fractures develop in the incandescent body in the course of time, they cannot have a harmful effect on the operating behavior of the burner, because the path for any fuel-air mixture entering such cracks is blocked by the lining to the rear, including the intake regions to the channels. The problems that can arise in conventional burners due to cracks and the like in the incandescent body are rendered harmless here. Therefore, even if cracks should develop, the burner can continue operating, which means that expensive repairs are avoided, and the service life of the burner is increased. The prevention of back-ignition that is achieved does not depend on the particular load on the burner. In other words, it is also possible to operate the burner at greatly reduced capacity, as is often desired, at least temporarily.

The lining can be made of a variety of metals, depending on the intended purpose of the burner and the requirements that it must satisfy. Examples of suitable metals are iron and especially heat-resistant steel.

In many cases it is sufficient for the intake sections of the lining to surround only the edge areas at the ends of the channels. In other cases, it may be advantageous for the intake regions to extend farther into the burner channels, especially about halfway along the length of the channels or even farther.

In one effective design, the intake sections and the rest of the lining consist of a single piece. This type of piece can be produced especially by the shaping (e.g., pressing, punching, piercing, or a combination of such operations) of a platelike workpiece provided as the lining, especially a piece of sheet metal.

It is also possible, however, to produce the intake sections as parts that are separate from the flat lining and to join them to the lining during the construction of the burner head. The two parts can be joined permanently or detachably, either by a positive interlocking connection of the parts or by a friction-locking connection, e.g., a force fit.

The lining can rest directly against the incandescent body. Depending on the requirements, however, it is also possible to provide an intermediate layer between the incandescent body and the metal lining, especially a layer consisting of heat-resistant nonwoven fabric or a layer of a refractory compound.

This is advantageous especially when a prefabricated incandescent body consisting of one or more parts, e.g., a ceramic plate, is to be joined to the lining to form the burner head. The purpose of the intermediate layer may merely be to even out any small dimensional variations that may be present in the parts. It can also be used as a special joining material and may be composed to produce reliable adhesion between the parts.

The burner channels, at least in the parts next to the outer side of the incandescent body, can have a rotationally symmetric cross section with flaring, especially with a more or less curved contour.

In another advantageous design of the invention, the burner channels have a basically star-shaped cross section, at least in a part next to the outside of the incandescent body. The cross section has a central region and radial spaces which radiate from the central region and which are open towards the outside of the incandescent body. The central region can be open, or it can be closed towards the outside. An advantageous number of radial spaces is two to six, but the number can also be larger.

In another advantageous design, the burner channels can continue into at least two obliquely running individual channels, at least in a part next to the outside of the incandescent body. Here again, the number of channels is advantageously two to six, but a larger number is possible.

The various designs discussed above allow especially reliable operation of the radiant burner, achievement of a high degree of efficiency, operation at high temperatures, and rapid and intense heating of the incandescent body. These designs are especially important.

Another advantageous feature is that, regardless of the rest of the radiant burner's design, the burner channels or their parts end in outside recesses in the incandescent body. These recesses can be designed in various ways. It is especially advantageous to design them as areas enclosed by riblike projections of the incandescent body. Designs of this type have the advantage that the outlets of the burner channels are located in a protected area, so that negative effects of air currents on the front side of the burner are prevented or at least greatly reduced.

In one design of the burner, a space is provided on the side of the lining that faces away from the incandescent body. The fuel-air mixture is fed into this space and then flows into the burner channels.

In another advantageous design, a space is provided on the side of the lining facing away from the incandescent body for receiving at least one component of the fuel-air mixture. Supply lines for at least one other component of the fuel-air mixture, which are closed off from this space, are assigned to the burner channels, which open into the space. It is advantageous for these supply lines to extend into the burner channels.

The medium flowing through the supply lines picks up the medium in the neighboring space, so that a jet or injector effect is obtained, and intensive mixing and good flow conditions are achieved. It is especially advantageous to supply gas through the supply lines while air flows from the neighboring space, but an opposite arrangement is also possible.

In a radiant burner of this type, in which supply lines for one medium are assigned to the individual burner channels of a burner head, it is highly desirable for the burner channels to have either a round cross section (especially a circular cross section), at least in that part into which the supply lines extend, or an oval cross section, and also for the supply lines to have a polygonal cross section, at least in their terminal sections, which extend into the burner channels. An opposite design is also possible, however. Specific cross-sectional ratios can be achieved in this way.

In these types of designs, it is desirable to support at least the ends of the supply lines in the burner channels. Together with additional mounting of the supply lines, this provides for good centering.

As mentioned earlier, the incandescent body of the burner head can be produced separately from the lining, and then the two parts can be joined. It is also possible in accordance with the invention to apply a suitable compound for the formation of the incandescent body to a prefabricated lining. The compound is then hardened by drying, curing, baking, or some other process. The burner channels can be molded with templates, molds, or the like, or they can be produced later if they are not already formed by the inlet sections of the lining. A simple box-like mold, such as a sheet metal box, can be used to apply the compound for the incandescent body. It is also possible to use parts similar to a concrete form, to enclose and hold the compound as it is applied or poured. Depending on its nature and consistency, the compound can be applied by casting or pouring and especially by tamping or spraying.

Compounds that can be used for the incandescent body include compositions containing aluminum oxide, silicon dioxide, zirconium oxide, or similar substances. Materials are available which are extremely well suited to the production of an incandescent body with a metal lining. Modern materials, such as those used to produce or restore linings in industrial furnaces, especially ceramic fiber materials, are especially attractive for the production of incandescent bodies. Highly refractory materials are also available, and burners containing incandescent bodies made from these materials can be operated at high temperatures.

Further details, features, and advantages of the invention can be derived from the following specific examples, from the attached drawings, and from the claims.

DETAILED DESCRIPTION OF THE EMBODIMENTS

Figure 1:
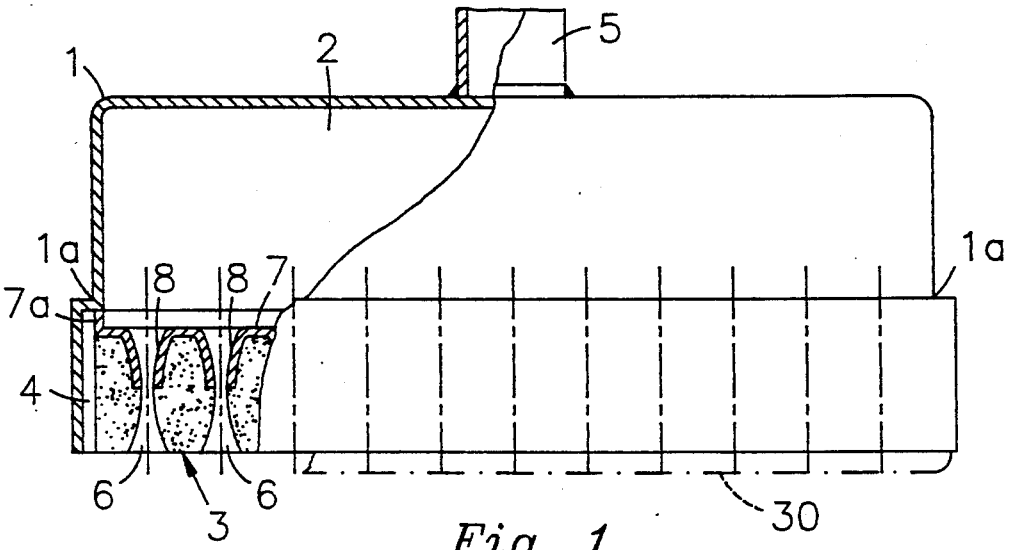
FIG. 1 is a first design of a radiant burner, partially cutaway.
Figure 2:
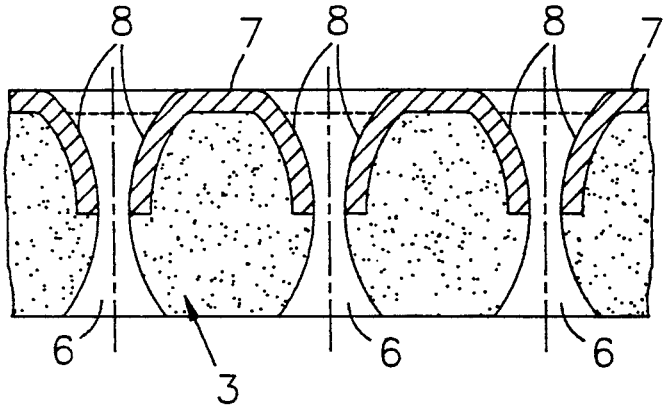
FIG. 2 is a cutaway of part of the lined incandescent body on a larger scale.
Figure 3:
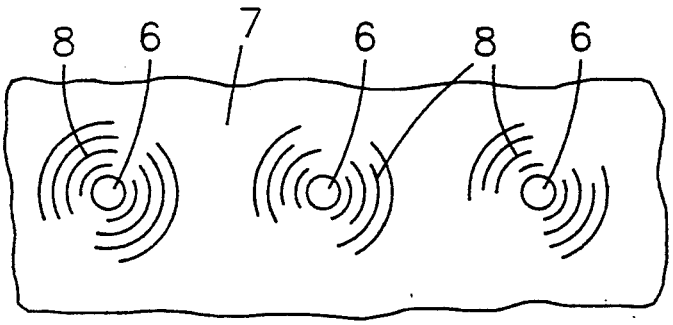
FIG. 3 is a top view of FIG. 2.

The infrared radiant burner shown in FIGS. 1–3 has a sheet metal housing 1 that encloses a space 2. A supply line 5 for a mixture of fuel gas (which may be gaseous or vaporized fuel) and air opens into this space. This mixture is produced by means that are already known for burners of this type and is supplied to the burner via suitable fittings, so that there is no need to discuss this subject in detail here.

The forward area of the burner (shown at the bottom in the drawing) has an incandescent body 3 made of a heat-resistant material. Incandescent body 3 is positioned in a shoulder 1*a* of housing 1 and is held in place by flanges, for example, at different points along the edge of the housing and/or with a refractory material 4 that fills the gap around the burner between the incandescent body and the housing. This also serves to seal the burner in these areas. Incandescent body 3, which has, for example, a basically square or rectangular shape, is provided with a number of burner channels 6, which are distributed regularly or in some particular pattern over the surface of the incandescent body. Burner channels 6 widen towards the outside, as is apparent in FIGS. 1 and 2. The wall can be straight, but it is more advantageous to have curved walls, as shown in the drawings. The shape and length of the widening of the burner channels depends on the requirements of each individual case. The shape and length of the widening are selected in such a way that the stream of gas mixture decelerates until at a certain point in the channel the conditions with respect to the rate of flame propagation are such that combustion stops at that point.

The inner side of incandescent body 3 is provided with a basically platelike lining 7, which in this design is made of refined steel plate and is fitted tightly to the incandescent body. Together with inlet sections 8, which are formed from the plate itself, lining 7 extends into burner channels 6, so that it also covers the incandescent body in these areas. The inlets of channels 6 have a larger diameter on the side coming from mixing chamber 2 than at the narrowest channel cross section, and the diameter decreases towards that narrowest point.

The length of inlet sections 8 can vary, depending on the circumstances. It is advantageously about half the total length L of channels 6, but it can also be smaller or larger.

Lining 7 completely seals incandescent body 3 towards the inside, i.e., on the side facing chamber 2, so that even if cracks should develop in the incandescent body, no back-ignition can occur through these cracks.

Lining 7 can be flat at its edges. It can surround the edges of incandescent body 3 or have, for example, high bent edges 7*a*, which fit tightly against shoulder 1*a* of housing 1.

Figure 4:
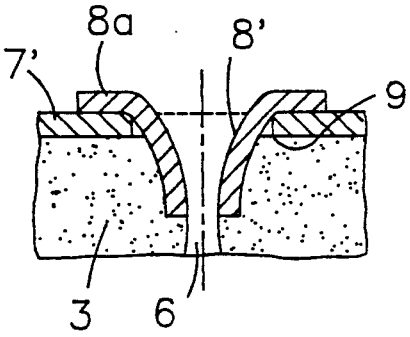
FIG. 4 is a modified design of a section corresponding approximately to the section shown in FIG. 2.

In the design shown in FIGS. 1–3, inlet sections 8 and lining 7 consist of one piece. FIG. 4 shows a design in which inlet sections 8' are separately produced parts that are inserted in holes in lining 7' and rest on lining 7' with a flangelike edge 8*a*. Parts 8' can be firmly attached to plate 7' by pressing them into holes 9, or they can be mounted on the plate by other suitable means.

Figure 5:
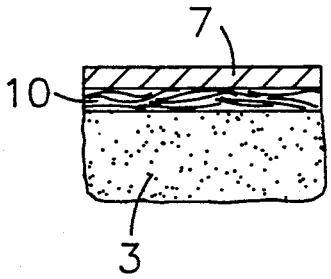
FIG. 5 shows additional detail in a cutaway view.

In the designs shown in FIGS. 1–4, the material of incandescent body 3 rests directly against the underside of lining 7. FIG. 5 shows a design in which an intermediate layer 10 is located between incandescent body 3 and lining 7. This layer can consist in particular of a nonwoven fabric.

Figure 6:
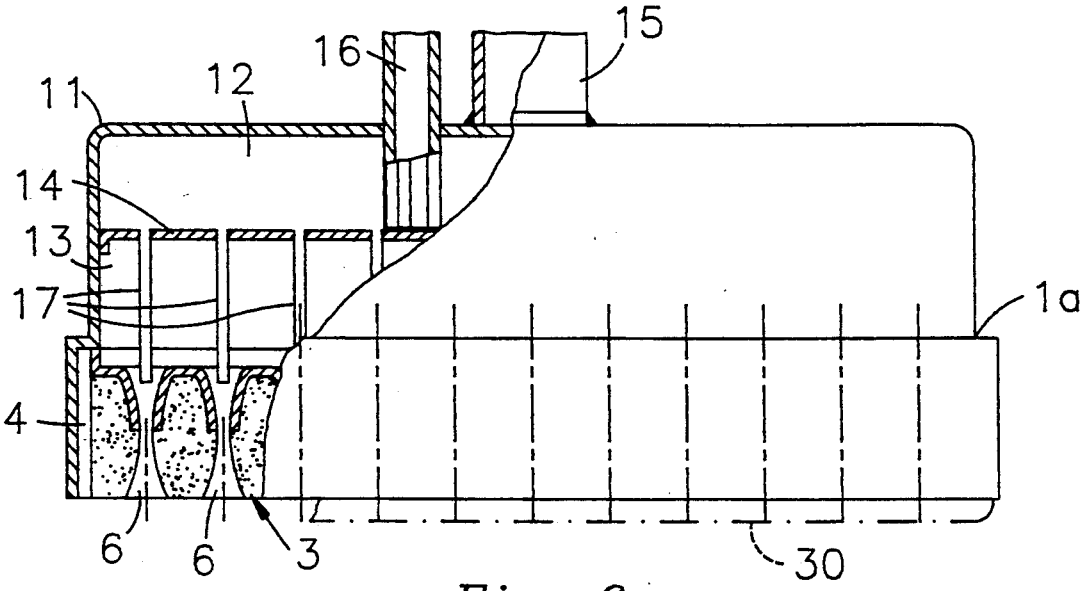
FIG. 6 is another partially cutaway design of a radiant burner.
Figure 7:
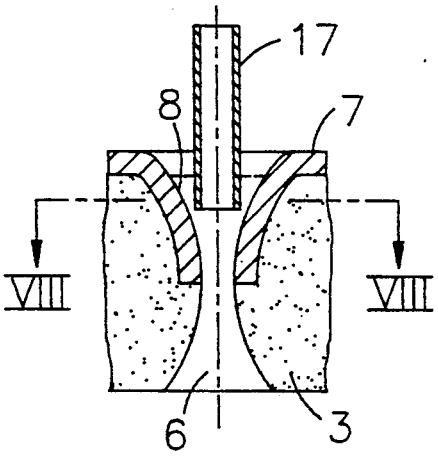
FIG. 7 is a cutaway section of the incandescent body of the burner in FIG. 6 on a larger scale.
Figure 8:
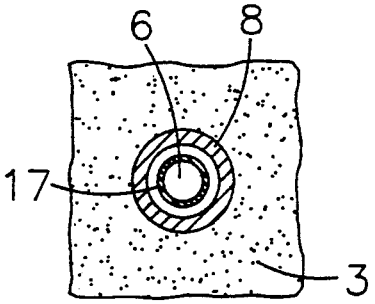
FIG. 8 is a cross section along line VIII—VIII in FIG. 7.

FIGS. 6–8 show another design of a radiant burner. A metal housing 11 contains two chambers 12 and 13, which are separated from each other by a wall 14. A supply line 15 for fuel gas opens into chamber 12, while a supply line 16 for combustion air opens into chamber 13. Supply lines 17 in the form of metal tubes are mounted firmly and tightly (e.g., by welding or soldering) in holes in partition wall 14.

As in the design discussed above, the burner has a burner head with an incandescent body 3 containing burner channels 6 and is covered by a lining 7, 8. Parts that are the same as parts in FIGS. 1–3 or that correspond to those parts are labeled with the same reference numbers as in FIGS. 1–3. Everything said about these parts in connection with FIGS. 1–3 also applies here.

Each burner channel 6 has a supply line 17, which extends a certain distance into burner channel 6. The ends of supply lines 17 do not need to be in contact with the wall of the burner channel. In this case, supply lines 17 are supported only by partition wall 14. It is not critical for the axes of supply lines 17 be exactly coaxial to the longitudinal axes of associated channels 6. The medium flowing from chamber 12 through supply lines 17 draws the medium in chamber 13 with it, so that intensive mixing takes place, and the resulting combustible mixture continues to flow in the channel until it burns at the desired point in the channel.

Chamber 12 was specified above as the intake chamber for fuel gas, and chamber 13 was specified as the intake chamber for combustion air. However, the opposite may also be the case; i.e., chamber 12 may be supplied with air through supply tube 15, while chamber 13 is supplied with fuel gas through supply tube 16.

FIG. 8 shows a supply line 17 with a circular cross section and a burner channel 6, which also has a circular cross section. Other designs are also possible, such as those shown in FIGS. 9–11, which show approximately the same cross section as in FIG. 8. In these designs, the dimensions of the supply lines and burner channels can be selected in such a way that the ends of the supply lines are supported by the walls of the burner channels or by the inlet sections of the lining.

Figure 9:
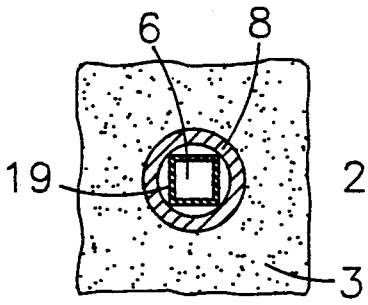
FIGS. 9–11 show modified designs in approximately the same cross sections as FIG. 8.
Figure 10:
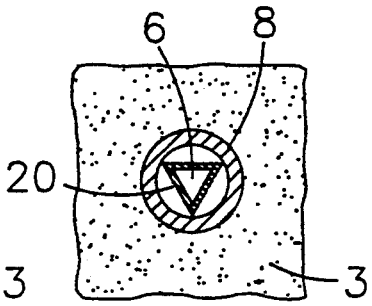
Figure 11:
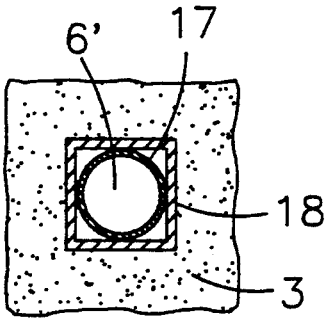

FIG. 9 shows a supply line 19 in the form of a tube with a square cross section, and FIG. 10 shows a supply line 20 in the form of a tube with a triangular cross section. In each case, burner channel 6 has a circular cross section. In the design shown in FIG. 11, burner channel 6' and thus inlet section 18 of the lining have a square cross section, while supply line 17 has a circular cross section.

Depending on the circumstances and requirements and regardless of the specific design, the burner can also be equipped with a grate, screen, or the like, which is placed in front of the incandescent body. In FIGS. 1 and 6, such a screen is indicated in broken lines and labeled with the number 30.

Figure 12:
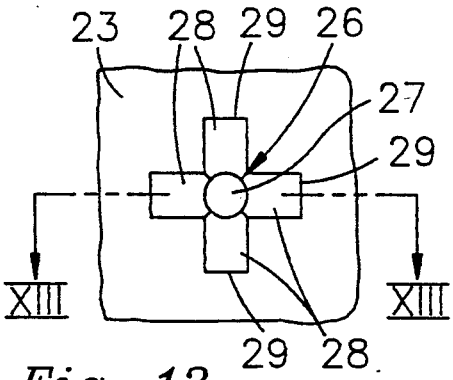
FIG. 12 is another design of a burner channel and shows a top view of the outside of the incandescent body.
Figure 13:
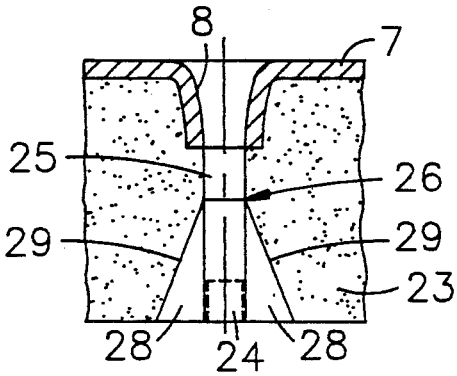
FIG. 13 is a cross section along line XIII—XIII in FIG. 12.

FIGS. 12 and 13 show another design for a burner channel 26. Following a cylindrical part 25, the burner channel has an essentially star-shaped cross section with a central region 27 and more-or-less groove-like radial spaces 28, which extend outward from central region 27 and which are open towards the outside of incandescent body 23. These radial spaces 28 have boundary surfaces 29, which run obliquely to the axis of burner channel 26 and form the base of the groove; they have a rectangular cross section, as the drawings show. However, a different cross-sectional shape can be chosen.

Central region 27 can be open or closed towards the outside of incandescent body 23. The latter case is shown in FIG. 13 by a part 24, indicated in broken line, of incandescent body 23 which has been left in place. A plug can also be inserted here.

Figure 14:
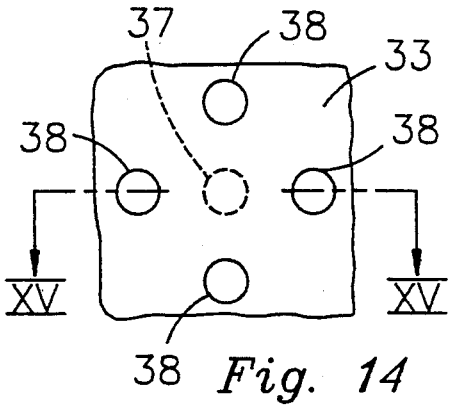
FIG. 14 is another design of a burner channel in a top view corresponding to FIG. 12.
Figure 15:
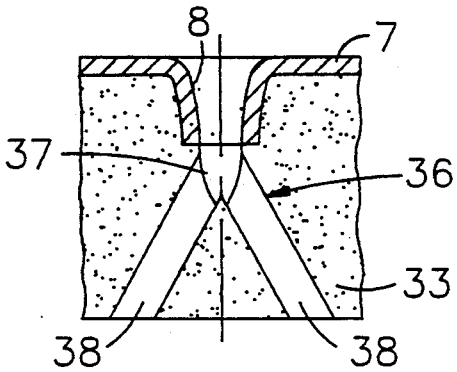
FIG. 15 is a cross section along line XV—XV in FIG. 14.

In the design shown in FIGS. 14 and 15, active parts of burner channels 36 are formed by individual channels 38, which run obliquely to the axis of the burner channel in incandescent body 33. In a modification of the design shown here, a central portion of channel 37 can also extend completely through incandescent body 33 to the outside surface.

FIGS. 12 and 13 and FIGS. 14 and 15 show four radial spaces 28 and four individual channels 38, respectively. However, a different number of spaces or channels can be selected. Both even and odd numbers of such radial spaces or individual channels are possible.

Figure 16:
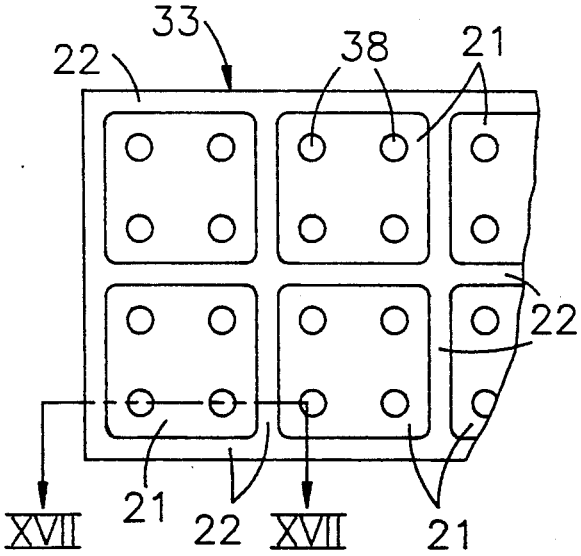
FIG. 16 is a partial top view of the outside of an incandescent body that is specially designed in this section.
Figure 17:
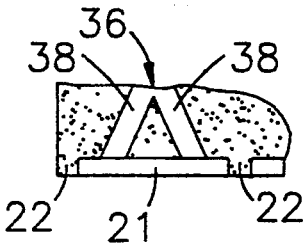
FIG. 17 is a cross section along line XVII—XVII in FIG. 16.

FIGS. 16 and 17 show a design for an incandescent body 33 that is of fundamental importance regardless of the type, design, or arrangement of the burner channels. The burner channels or, in this case, their parts 38 (corresponding approximately to a design in accordance with FIGS. 14 and 15) terminate in recesses 21 external to or in the front surface of incandescent body 33. This provides effective protection against the undesirable effects of external air currents. In the specific example shown here, recesses 21 form areas that are surrounded in a framelike fashion by riblike projections 22 of incandescent body 33.

Figure 18:
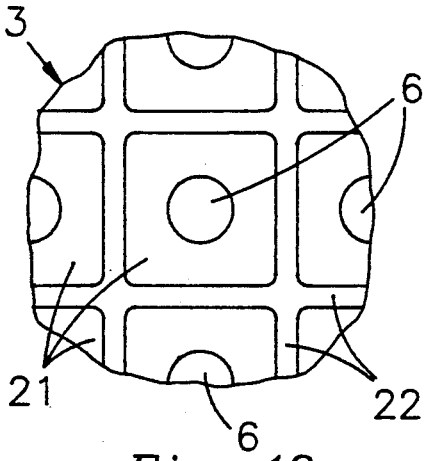
FIG. 18 is a partial top view of the outside of a specially designed incandescent body.

FIG. 18 shows a similar design with recesses 21 in the front surface of incandescent body 3. In this case, burner channels 6 are present which more or less correspond to the designs shown in FIGS. 1–4 and FIGS. 6–11.

All of the individual features and combinations of features mentioned in the above description or shown in the drawings are to be regarded as part of the invention, excepting those which are already known from the state of the art.

What is claimed is:

1. A radiant burner capable of being operated with a mixture of gaseous or vaporized fuel and air comprising:

a hollow housing having inlet and outlet openings;

said inlet opening receiving the air/fuel mixture;

said outlet opening being spaced from said inlet opening whereby the hollow space between said inlet and outlet openings delivers the air/fuel mixture entering through said inlet opening toward said outlet opening;

a burner head comprised of an incandescent body being positioned within said outlet opening;

said incandescent body having a plurality of individual burner channels extending through said incandescent body, said openings communicating with said hollow space;

the surface of said incandescent body exposed to said hollow interior space being provided with metallic liming means;

said metallic liming means providing a substantially impenetrable seal to prevent cracks or fractures which may develop in the incandescent body from having a harmful effect upon the operation of the burner;

said metallic lining means having inlet openings each communicating with an associated one of said burner channels for enabling the air/fuel mixture passing through said hollow interior space to be delivered into said channels.

2. The radiant burner of claim 1 wherein each of said burner channels have a length L, portions of said metallic lining means defining said openings extending at least partially into its associated channel.

3. The radiant burner of claim 1 wherein said channels comprise an inlet end adjacent to and communicating with said hollow interior space and an outlet end terminating in a surface of said burner element remote from said hollow interior space;

each channel having at least a portion thereof which widens as it approaches the outlet end.

4. The radiant burner of claim 1 wherein said channels taper inwardly from the ends communicating with said hollow space toward an intermediate portion thereof and thereafter taper outwardly from the intermediate portion thereof toward the outlet end of each channel removed from said hollow space.

5. The radiant burner of claim 1 wherein each channel has an inlet end adjacent said lining, each channel terminating in an outlet end on the surface of the incandescent body external to said housing which is larger in size than its inlet.

6. The radiant burner of claim 5 wherein each outlet opening has a substantially cross-shaped configuration.

7. The radiant burner of claim 1 wherein each channel has an inlet end communicating with said hollow interior space and a plurality of outlet ends communicating with said inlet and outlet ends and terminating on the surface of said incandescent body external to said housing.

8. The radiant burner of claim 7 wherein the outlet ends communicating with a common inlet end are arranged at equispaced intervals about an imaginary center point on the surface of said incandescent member which point is equidistant from the centers of said outlet openings.

9. The radiant burner of claim 8 wherein there are four outlet openings communicating with a common inlet opening.

10. A process for producing a burner head for a radiant burner comprising the steps of:

providing an incandescent body having first and second opposing major surfaces and a periphery extending between said major surfaces;

forming a plurality of channels in said incandescent body, which channels communicate between first and second opposing major surfaces;

forming a metallic lining conforming to the shape of one of the major surfaces of said incandescent body;

joining said lining and said incandescent body together;

forming inlet openings in said metallic lining, each being coaxial with one of said channels, including forming said metallic lining to extend at least partially into each channel, the portion of the lining extending into each channel terminating in said inlet opening;

mounting said burner head within the open end of a hollow supporting housing engaging the burner head about the periphery thereof;

said housing and burner head defining a hollow interior space;

providing at least open opening in said housing for introducing fuel and/or air which ultimately flows into said channels;

positioning said burner head in said housing with said lining means facing said hollow interior space.

11. A method for producing a burner head for a radiant burner comprising the steps of:

forming a metallic lining provided with a plurality of openings, providing a compound for forming an incandescent body;

applying said compound to one surface of said lining and allowing said compound to harden;

providing channels in said compound each communicating with an associated one of the openings in said lining.

12. The method of claim 11 wherein said channels are formed after hardening.

13. The method of claim 11 wherein said channels are formed prior to hardening.

14. The method of claim 13 wherein said compound is applied to said lining by tamping.

15. The method of claim 14 wherein said compound is applied to said lining by spraying.

16. The method of claim 11 wherein said incandescent body is joined to said lining by means of an intermediate layer positioned upon said lining prior to application of said compound.

17. The method of claim 16 wherein said intermediate layer comprises a non-woven fabric.

18. A radiant burner, for receiving a mixture of gaseous or vaporized fuel and air and which includes a hollow housing having inlet and outlet openings spaced apart by a hollow interior region, and a burner head positioned in said outlet opening and including an incandescent body that contains individual burner channels communicating with said hollow interior region, the cross-sectional area of each of said burner channels increasing in size from a first location a predetermined distance from the surface of the incandescent body facing the hollow interior region to a second location along said channel further removed from said first location, the surface of the incandescent body facing said hollow interior region being provided with a metal lining having inlet portions each extending partially into an associated one of the burner channels and terminating in an opening aligned with its associated burner channel, said metal lining being substantially impenetrable except for the channel inlets.

19. A radiant burner in accordance with claim 18, wherein on the side of the metal lining (7) facing away from the incandescent body (3), there is provided a barrier (14) for dividing said hollow interior space into first and second chambers, said first chamber receiving at least one component of the fuel-air mixture, and said second chamber receiving the remaining component of said fuel-air mixture;

each of the burner channels directly receiving the component introduced into said first chamber, and a plurality of supply lines directing the component introduced into said second chamber to said channels.

20. A radiant burner in accordance with claim 18, wherein the inlet sections (8) and the remainder of the lining (7) are formed in a single member which serves as said lining.

21. A radiant burner in accordance with claims 18 or 20, wherein the inlet sections (8) are provided in a plate-like workpiece used as the lining (7), each of said inlet sections having a shape conforming to the surface of the incandescent body facing said hollow interior region.

22. A radiant burner in accordance with claim 19, wherein one end of each of the supply lines (17) extends at least partially into one of the burner channels (6).

23. A radiant burner in accordance with claim 22, wherein the burner channels (6) have a circular cross-section, at least in the area into which the supply lines (19, 20) extend; and the supply lines (19, 20) have a polygonal cross-section, at least in the portion of their length which extends into the burner channels (6).

24. A radiant burner in accordance with claim 23, wherein the supply lines (17, 19, 20) are supported by one of the burner channels (6) and the inlet sections (8) associated with the burner channels (6).

25. A radiant burner in accordance with claim 22, wherein the burner channels (6') have a polygonal cross-section, at least in the region into which the supply lines (17) extend; and the supply lines (17) have a circular cross-section, at least at that portion of their length which extends into the burner channels (6').

26. A radiant burner in accordance with claim 18, wherein the inlet sections (8') are independent from the lining (7), each of said inlet sections being joined to the lining.

27. A radiant burner in accordance with claim 18, wherein the inlet sections (8) extend into said burner channels and have a length which is at least half of the total length (L) of the burner channels (6).

28. A radiant burner in accordance with claim 18, wherein an intermediate layer (10) is provided between the incandescent body (3) and the lining (7) for compensating for any irregularities in the facing surfaces of the incandescent body and the lining.

29. A radiant burner in accordance with claim 18, wherein at least in a region near the surface of the incandescent body (23) remote from said hollow interior region, each of the burner channels (26, 36) has a substantially star-shaped cross-section comprised of a central region (27) and radial portions (28) extending outward from the central region to the exterior of the incandescent body (23).

30. A radiant burner in accordance with claim 29, wherein the central region (27) of said channels communicates with the surface of the incandescent body (23) remote from said hollow interior region.

31. A radiant burner in accordance with claim 29, wherein the central region (27) of said channels is closed in the region adjacent to the surface of the incandescent body (23) remote from said hollow interior region.

32. A radiant burner in accordance with claim 18, wherein at least in a region near the surface of the incandescent body (33) remote from said hollow interior region, each of the burner channels (26, 36) has at least two individual obliquely oriented channel portions (38).

33. A radiant burner in accordance with claim 18, wherein the burner channels (6, 6', 26, 36) terminate in recesses (21) in the incandescent body (3, 23, 33) said recesses being provided in the surface of the incandescent body remote from the hollow interior region.

34. A radiant burner in accordance with claim 33, wherein the recesses (21) are surrounded by integral riblike projections (22) provided in the incandescent body (3, 23, 33).

35. A radiant burner in accordance with claim 18, wherein the side of the lining (7) facing away from the incandescent body (3) cooperates with said housing to form the boundary of a chamber (2) for receiving the fuel-air mixture.

* * * * *

UNITED STATES PATENT AND TRADEMARK OFFICE

CERTIFICATE OF CORRECTION

PATENT NO. : 5,104,309

DATED : April 14, 1992

INVENTOR(S) : Kurt Kreiger

It is certified that error appears in the above-identified patent and that said Letters Patent is hereby corrected as shown below:

Column 7, Line 22, change "liming" to -- lining --

Column 7, Line 54, after "inlet" insert -- opening --

Column 8, Line 28, change "open" to -- one --

Signed and Sealed this

Seventeenth Day of August, 1993

Bruce Lehman

*Attest:*

BRUCE LEHMAN

*Attesting Officer*

*Commissioner of Patents and Trademarks*